US005733036A

United States Patent [19]

Montgomery

[11] Patent Number: 5,733,036

[45] Date of Patent: Mar. 31, 1998

[54] LOUVERED LIGHT CONTROL

[76] Inventor: Tommie Lee Montgomery, 841 Kansas, Norman, Okla. 73069

[21] Appl. No.: 726,065

[22] Filed: Oct. 3, 1996

[51] Int. Cl.[6] ..... F21V 17/02

[52] U.S. Cl. ..... 362/283; 362/284; 362/325; 362/324

[58] Field of Search ..... 362/217, 277, 362/279, 281, 283, 284, 354, 290, 321, 322, 323, 324, 325, 364, 365, 368

[56] References Cited

U.S. PATENT DOCUMENTS

| | | | |
|---|---|---|---|
| 1,176,120 | 3/1916 | Wilson | 362/325 |
| 1,326,393 | 12/1919 | D'Humy | 362/283 |
| 3,333,094 | 7/1967 | Steel | 362/283 |
| 3,604,922 | 9/1971 | Steel | 362/284 |
| 4,222,094 | 9/1980 | Wolar . | |
| 4,314,320 | 2/1982 | Wolar . | |
| 4,567,549 | 1/1986 | Lemme | 362/279 |
| 4,800,473 | 1/1989 | Tremblay . | |
| 5,276,601 | 1/1994 | Holzhacker | 362/354 |

*Primary Examiner*—Thomas M. Sember
*Attorney, Agent, or Firm*—James T. Robinson; John W. Wustenberg

[57] ABSTRACT

A louvered light control controls the light emitted by a standard drop-in fluorescent light fixture. The fluorescent light fixture is removed and a louver frame containing first and second louver assemblies stacked within the louver frame is inserted in place of the lens. The louver assemblies are oriented so that the louver vanes of the first louver assembly are at a right angle with respect to the louver vanes of the second louver assembly. Adjusting means for adjusting the movable vanes of the first and second louver assemblies between a relatively open position and a relatively closed position permit control of light emitted by the fluorescent light fixture.

10 Claims, 4 Drawing Sheets

LOUVERED LIGHT CONTROL

BACKGROUND OF THE INVENTION

1. Field of the Invention

This invention relates generally to the field of fluorescent lighting, and more particularly, but not by way of limitation, to a louvered light control for adjusting the light emitted by drop-in fluorescent light fixtures.

2. Discussion

Fluorescent light fixtures are standard in modern office lighting. The most common fluorescent light fixtures are 2-foot by 4-foot drop-in units for placement in a suspended ceiling grid, although 2-foot by 2-foot units are also used. Typical drop-in units include a lens disposed within a tilt-down lens frame.

Desktop computers have now become standard in modern offices. While fluorescent light fixtures provide cooler and cheaper lighting relative to incandescent lighting, overhead fluorescent lights can create glare on computer monitor screens. Typical efforts to reduce glare are directed toward non-reflective covers for the computer monitor screens. A better approach to eliminating the glare on computer monitor screens would be to direct light from the fluorescent fixtures away from the computer monitor screens, thereby avoiding glare while providing adequate room lighting.

Available methods and devices do not provide a cheap, easily manufactured, effective, light control which can be retrofitted for use in conjunction with existing commercial fluorescent light fixtures designed for installation in standard suspended ceiling grids.

SUMMARY OF THE INVENTION

The present invention provides a retrofittable louvered light control for adjusting the light emitted by drop-in fluorescent light fixtures. The term drop-in fluorescent light fixture is used herein to refer to a standard commercial fluorescent light fixture designed for installation in suspended ceiling grids.

Broadly speaking, the louvered light control replaces the lens of a drop-in fluorescent light fixture. A louver frame having a louver frame lip of dimensions substantially identical to the dimensions of the lens permits replacement of the lens by the louver frame. Two louver assemblies, each having parallel movable vanes attached to a control arm, are disposed within the louver frame and oriented at 90 degrees one relative to the other. Adjustment of the control arm adjusts the position of the parallel movable vanes between a relatively open position and a relatively closed position to control light emitted by the drop-in fluorescent light fixture.

In an alternate embodiment, the louvered light control is supported by the suspended ceiling grid and the fluorescent light fixture frame, with the lens removed therefrom, rests on the frame lip of the louver frame of the louvered light control.

The louvered light control is also suited for manufacture as an integral part of a fluorescent light fixture. The louvered light control reduces objectionable glare on computer monitors and permits control of light which is otherwise controlled only by selection of bulb wattage.

An object of the present invention is to provide an inexpensive, easily manufactured, and effective light control for use in conjunction with drop-in fluorescent light fixtures.

Another object of the present invention is to provide a light control which can be easily installed for use with existing drop-in fluorescent light fixtures.

Yet another object of the present invention is to provide a louvered light control which permits easy adjustment of light levels in a business office, notwithstanding the location of the fluorescent light fixture and the wattage of the fluorescent bulb.

Yet another object of the present invention is to provide a louvered light control which is motorized and can be operated remotely from a wall control.

Other objects, features, and advantages of the present invention will become clear from the following description of the preferred embodiment when read in conjunction with the accompanying drawings and appended claims.

DETAILED DESCRIPTION OF THE INVENTION

In the following description of the present invention, like numerals and characters designate like elements throughout the figures of the drawings.

Figure 1:
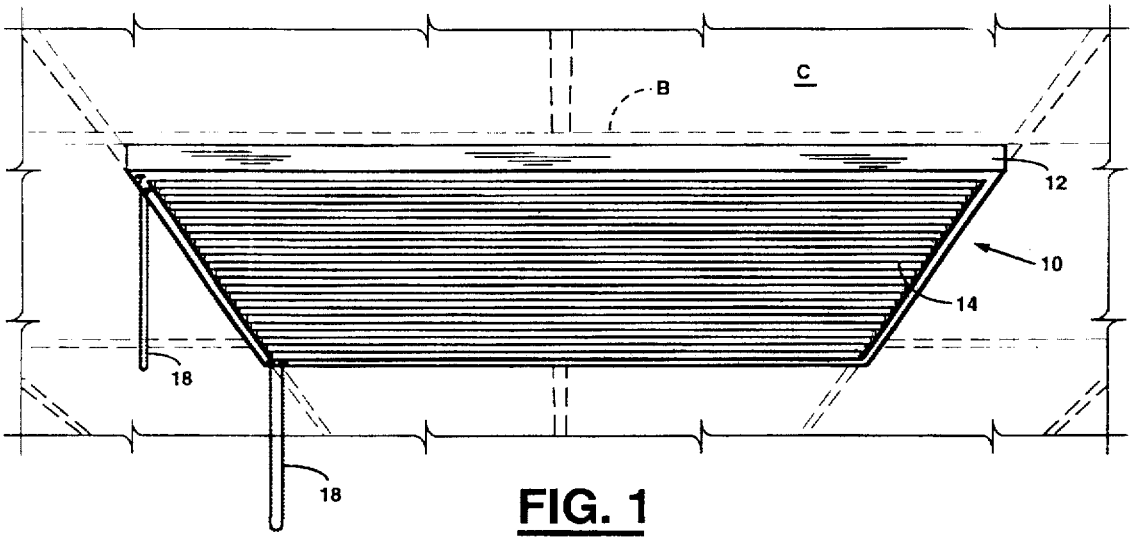
FIG. 1 is a view of a the louvered light control installed in a drop-in fluorescent light fixture in accordance with the present invention.
Figure 2:
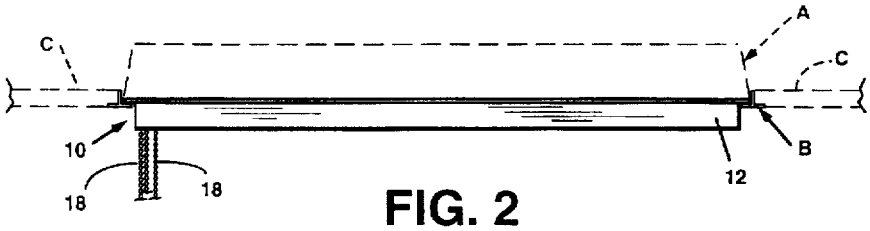
FIG. 2 is a cross-sectional view of the louvered light control depicted in FIG. 1.
Figure 3:
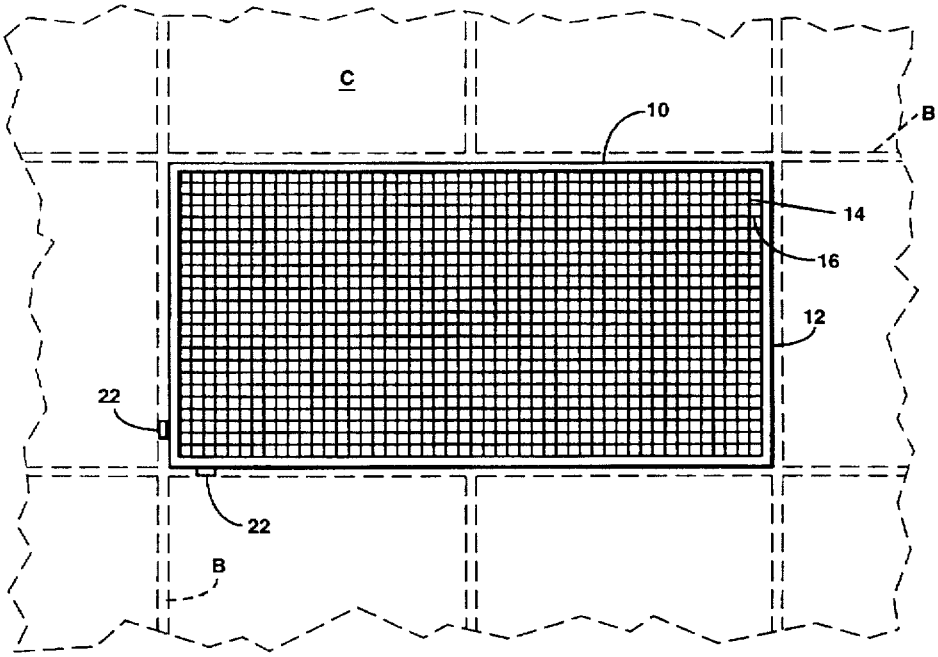
FIG. 3 is a perspective view of the louvered light control depicted in FIGS. 1 and 2.

Referring generally to the drawings and more particularly to FIGS. 1–3, a louvered light control 10 is shown with a drop-in fluorescent light fixture A (not visible) installed in suspended ceiling grid B. The suspended ceiling grid B also supports ceiling tiles C. A louver frame 12 extends downwardly from lens frame C of the drop-in fluorescent light fixture A and encloses adjustable louver assemblies 14, 16. Louver assemblies 14 and 16 are disposed so louver assembly 14 is adjustable along an axis which is 90 degrees relative to the axis of adjustment of louver assembly 16.

Adjusting chains 18 attached to adjusting gears 20 (depicted in FIGS. 4–9) permit adjustment of louver assemblies 14, 16 to control the light emitted from the fluorescent light fixture A.

Figure 5:
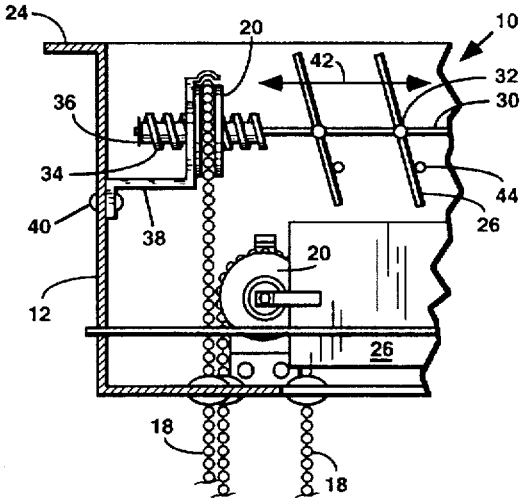
FIG. 5 is generally a further detail of the louvered light control depicted in FIGS. 1–4.
Figure 7:
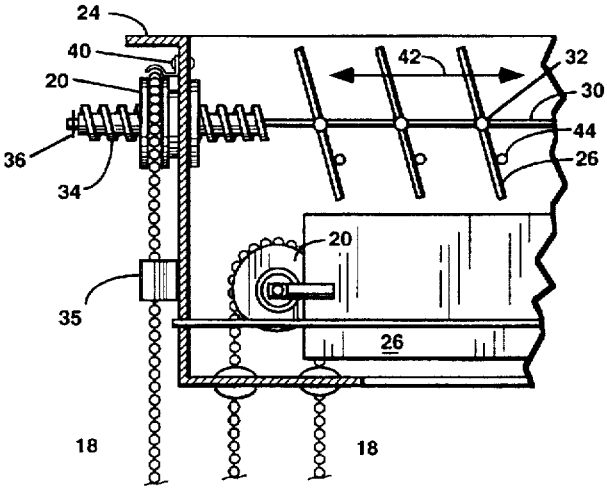
FIG. 7 is a detail of a second embodiment of the louvered light control of the present invention.
Figure 8:
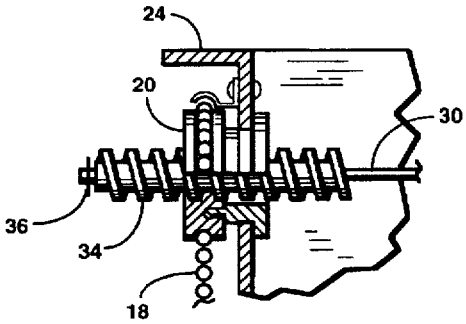
FIG. 8 is a further detail of the louvered light control depicted in FIG. 7.

Referring now to FIGS. 1 and 3, the embodiment depicted in FIG. 1 indicates the adjusting chains 18 are attached to adjusting gears 20 disposed within the louver frame 12. In FIG. 3, adjusting gear housings 22 mounted on the exterior of the louver frame 12 enclose the adjusting chains 18 (not shown) which are attached to adjusting gears 20 (not shown). FIG. 5 is a detail of the arrangement of FIG. 1, while FIGS. 7 and 8 provide detail of the adjusting chains 18 and the adjusting gears 20 as depicted in FIG. 3.

Figure 4:
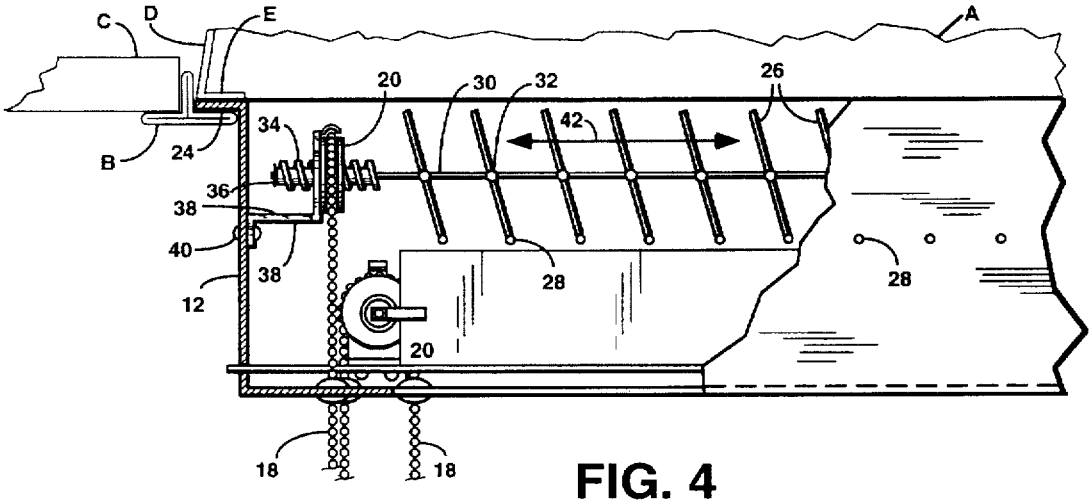
FIG. 4 is a view, partially broken away, of a portion of the louvered light control depicted in FIGS. 1–3, wherein the louvered light control is supported by the suspended ceiling grid and the drop-in fluorescent light fixture rests on the louvered light control's louver frame lip.

Referring now to FIG. 4, shown therein is a louvered light control 10 supported by the suspended ceiling grid B. A louver frame lip 24 of the louver frame 12 rests within the horizontal portion of the suspended ceiling grid B, which also supports the acoustic ceiling tile C. The housing lip E of the housing D of the fluorescent light fixture A rests on the louver frame lip 24 of the louver frame 12.

Still referring to FIG. 4, louvers 26 (also referred to as vanes) are attached to the louver frame 12 by a first pivot pin 28 and to a control arm 30 by a second pivot pin 32. An end of the control arm 30 is disposed within a worm gear 34 and secured by a keeper 36. The worm gear 34 and adjusting gear 20 are mounted on a bracket 38 which is attached to the inside surface of the louver frame 12 by a fastener 40. Arrow 42 indicates the direction of movement of the free ends of the louvers 26.

Movement of one of the adjusting chains 18 causes the adjusting gear 20 to rotate, the worm gear 34 to move within the adjusting gear 20, and the control arm 30 to move in the direction indicated by arrow 42. As the control arm 30 moves in the direction indicated by the arrow 42, the vanes 26 move from a relatively closed position to a relatively open position and back to a relatively closed position.

Referring now to FIG. 5, depicted therein is a modified further detail of the louvered light control 10 of FIG. 4. Whereas, in FIG. 4, one end of the louvers is attached to the louver frame 12 by means of the first pivot pin 28, in FIG. 5 an alternate pivot pin 44, positioned nearer the second pivot pin 32, produces travel of the control arm 30 in the direction of the arrow 42 when the drive gear 34 is driven by the adjusting gear 20. As a result of the control arm's movement in the direction of the arrow 42, the louvers 26 move from a relatively closed position to a relatively open position and back to a relatively closed position.

Figure 6:
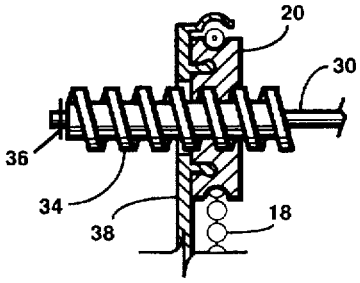
FIG. 6 is a further detail of the louvered light control depicted in FIG. 5.

Referring now to FIG. 6, depicted therein is a further detail of the adjusting chain 18, the adjusting gear 20, the worm gear 34, the keeper 36, and the bracket 38 of the louvered light control 10 of FIG. 4.

Referring now to FIGS. 7 and 8, depicted therein is a second embodiment in which the adjusting gear 20 is mounted on the outside the louver frame 12 (see FIG. 3). A chain guide 35 keeps the adjusting chain 18 in a substantially vertically alignment. It will understood by one skilled in the art that the adjusting gear 20 can be mounted on the outside surface of the louver frame 12 (as depicted in FIGS. 7 and 8), or on the inside surface of the louver frame 12 (as illustrated in FIGS. 4, 5, 6, 8, 11 and 14).

Figure 9:
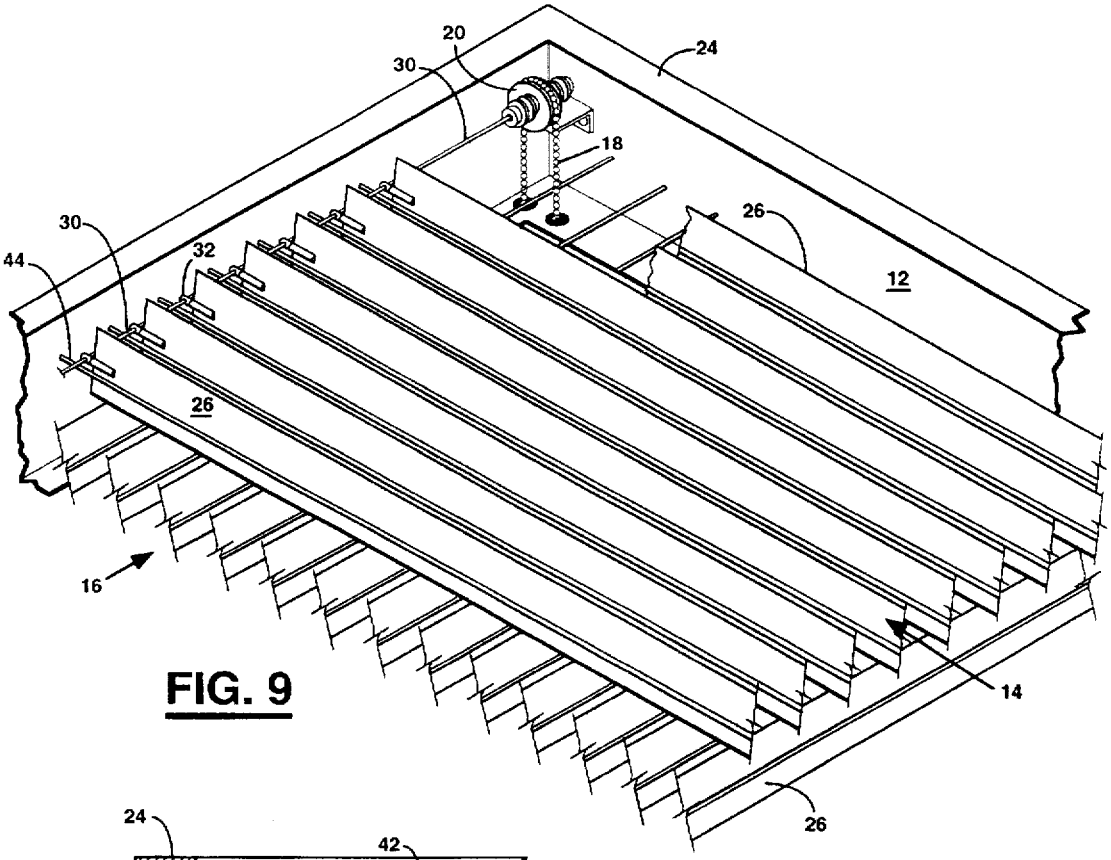
FIG. 9 is another view of the louvered light control depicted in FIG. 5.

Referring now to FIG. 9, shown therein is another view of the embodiment of the louvered light control 10 as depicted in FIG. 5. Louver assemblies 14, 16 are disposed within the louver frame 12.

Figure 10:
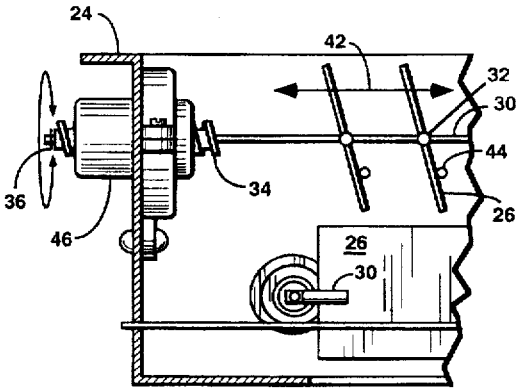
FIG. 10 is a detail of a third embodiment of the louvered light control of the present invention.
Figure 11:
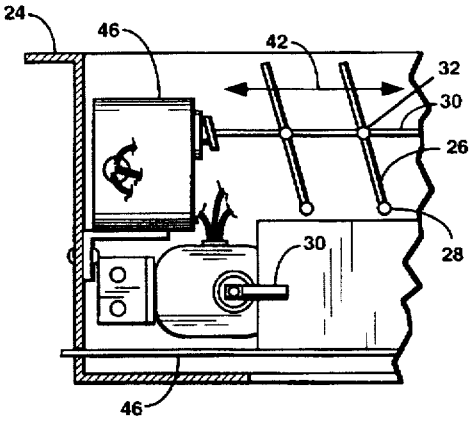
FIG. 11 is a further detail of the louvered light control depicted in FIG. 10.
Figure 12:
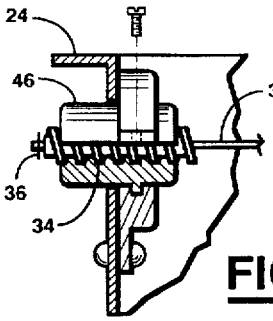
FIG. 12 is a further detail of the louvered light control depicted if FIGS. 10–11.

Referring now to FIGS. 10–12, depicted therein is a third embodiment of the louvered light control 10 in accordance with the present invention. A reversible electric drive motor 46, through the worm gear 34, causes the control arm 30 to move in the direction indicated by the arrow 42. As a result of the control arm's movement in the direction of the arrow 42, the louvers 26 move from a relatively closed position to a relatively open position and back to a relatively closed position.

Figure 13:
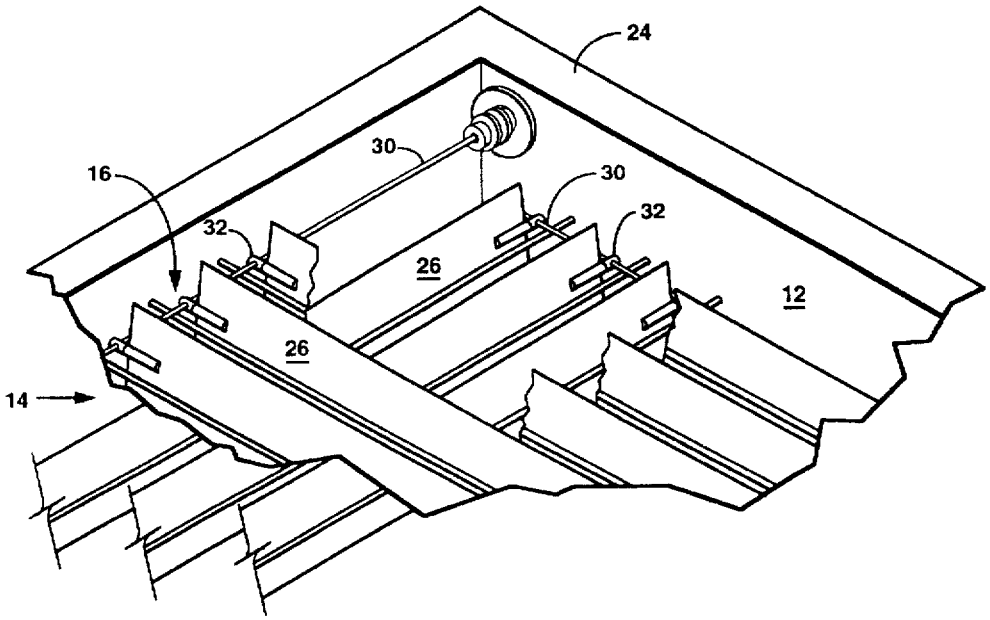
FIG. 13 is a further detail, partially cut away, of the louvered light control depicted in FIG. 1.

Referring now to FIG. 13, shown therein is a further detail of the embodiment depicted in FIGS. 10–12. Louver assemblies 14, 16 are disposed within the louver frame 12.

Figure 14:
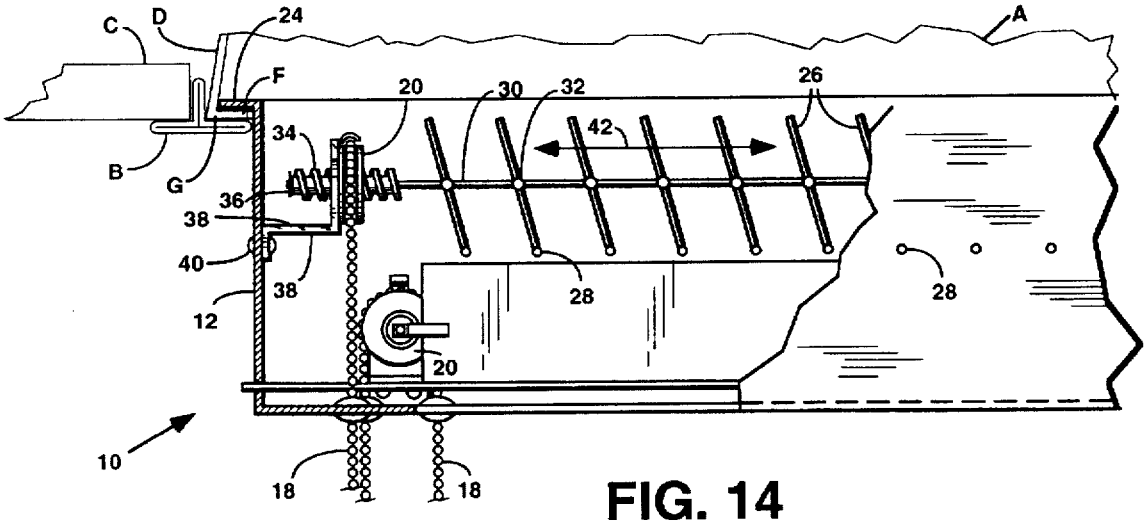
FIG. 14 is a view, like FIG. 4, of the louvered light control of the present invention in which the louvered light control replaces the lens in a drop-in fluorescent light fixture.

Referring now to FIG. 14, shown therein is a fourth embodiment of the louvered light control 10 in accordance with the present invention. The louver frame lip 24 of the louver frame 12 rests within and is supported by the lens frame F of the fluorescent light fixture A. The lens frame F is attached by hinge G to the housing lip E of the housing D of the fluorescent light fixture A. If the lens frame F tilts downward (e.g., for replacement of fluorescent bulbs), the louvered light control 10 of FIG. 14 will tilt down in conjunction with the lens frame F. The chain guide 35 keeps the adjusting chain 18 in substantially vertical alignment when the lens frame F and the louvered light control 10 are tilted downward.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A louvered light control for controlling light emitted by a drop-in fluorescent light fixture for placement in a suspended ceiling grid opening, the drop-in fluorescent light fixture characterized as having a housing and a lens disposed within a lens frame, the louvered light control comprising:

a louver frame characterized as having an inside surface and an outside surface;

a first louver assembly disposed within and supported by said louver frame, said first louver assembly comprising a plurality of substantially parallel movable vanes;

a second louver assembly disposed within and supported by said louver frame, said second louver assembly comprising a plurality of substantially parallel movable vanes, so that said vanes of said first louver assembly are disposed at a right angle with respect to said vanes of said second louver assembly;

adjusting means for adjusting said movable vanes of said first and second louver assemblies between a relatively open position and a relatively closed position; and mounting means for mounting said louver frame below the drop-in fluorescent light fixture.

2. The invention as recited in claim 1, wherein said mounting means comprises a louver frame lip extending horizontally from said louver frame, said louver frame lip resting in the lens frame so that the lens frame supports said louver frame below the fluorescent light fixture.

3. The invention as recited in claim 1, wherein said adjusting means for adjusting said movable vanes further comprises:

a first pivot pin attached to each vane of said movable vanes and to said louver frame;

a second pivot pin attached to each said vane of said movable vanes and to a control arm disposed within a worm gear;

an adjusting gear engaging said worm gear so that, when said adjusting gear is rotated about said worm gear, said control arm is caused to move, thereby causing each vane of said movable vanes to move between a relatively open position and a relatively closed position; and means for moving said adjusting gear.

4. The invention as recited in claim 3, wherein said adjusting means is mounted on a bracket secured to said inside surface of said louver frame.

5. The invention as recited in claim 3, wherein said adjusting means is mounted on a bracket secured to said outside surface of said louver frame.

6. The invention as recited in claim 3, wherein said means for moving said adjusting gear comprises a chain engaging said adjusting gear, said chain having sufficient length to extend downwardly from said louver frame so that said adjusting gear is caused to rotate when a person pulls said chain.

7. The invention as recited in claim 3, wherein said means for moving said adjusting gear comprises a reversible electric motor coupled to said adjusting gear, so that said adjusting gear is caused to rotate when said electric motor is energized.

8. The invention as recited in claim 7, wherein said reversible electric motor is controlled by a wall switch.

9. The invention as recited in claim 1, wherein said adjusting means for adjusting said movable vanes of said first and second louver assemblies between a relatively open position and a relatively closed position comprises:

a first pivot pin attached to each vane of said substantially parallel movable vanes and to said louver frame;

a second pivot pin attached to each said vane of said substantially parallel movable vanes and to a control arm, said control arm extending through said louver frame to permit adjustment of said vanes between a relatively open position and a relatively closed position when said control arm is manually positioned.

10. The invention as recited in claim 3, wherein said means for moving said adjusting gear comprises ridges disposed about the circumference of said adjusting gear so that said adjusting gear can be moved by a person's fingers.

* * * * *